US006131368A

United States Patent [19]

Tramposch et al.

[11] Patent Number: 6,131,368

[45] **Date of Patent: *Oct. 17, 2000**

[54] METHOD FOR PACKAGING ADSORBENTS

[75] Inventors: Walter G. Tramposch, Moon Township; Mick Greenback, Monaca, both of Pa.

[73] Assignee: Calgon Carbon Corporation

[ * ] Notice: This patent is subject to a terminal disclaimer.

[21] Appl. No.: 09/056,305

[22] Filed: Apr. 7, 1998

[51] Int. Cl.[7] ..... B65B 31/00

[52] U.S. Cl. ..... 53/400; 53/432; 53/434; 53/440

[58] Field of Search ..... 53/400, 403, 405, 53/440, 432, 434

[56] References Cited

U.S. PATENT DOCUMENTS

| | | | |
|---|---|---|---|
| 4,450,878 | 5/1984 | Takada et al. | 53/440 X |
| 5,009,308 | 4/1991 | Cullen et al. | 53/440 X |
| 5,251,424 | 10/1993 | Zenger et al. | 53/440 X |
| 5,709,065 | 1/1998 | Krause | 53/440 X |
| 5,799,463 | 9/1998 | Kashiba | 53/440 X |
| 5,839,258 | 11/1998 | Takayanagi et al. | 53/428 X |
| 6,000,198 | 12/1999 | Tramposch | 53/400 |

*Primary Examiner*—Linda Johnson
*Attorney, Agent, or Firm*—Cohen & Grigsby, P.C.

[57] ABSTRACT

A method is provided for hermetic packaging of unimpregnated and impregnated adsorbents which provides for improved packing densities, reduced attrition losses, and reduced exposure of the adsorbent to environmental or other contamination. Furthermore, the method inherently provides for identification of instances of packaging failure. The method entails hermetically sealing a collapsible gas and vapor impermeable vessel containing an adsorbent which is at an elevated temperature. Subsequent cooling of the adsorbent results in the production of a partial vacuum within the vessel. As a result of this partial vacuum, the environmental atmospheric pressure collapses the vessel to firmly compresses the adsorbent in a hermetically sealed low-pressure environment to provide the stated advantages.

15 Claims, No Drawings

METHOD FOR PACKAGING ADSORBENTS

FIELD OF THE INVENTION

The present invention relates to a method for packaging unimpregnated and impregnated adsorbents, and in particular, to a method of packaging adsorbents in a hermetically sealable package with a reduced pressure.

BACKGROUND OF THE INVENTION

It is well known that adsorbents, by their very nature, are susceptible to contamination from environmental sources. This contamination can result in the adsorbent exhibiting lowered adsorption capacity, reduced functionality, or reduced adsorption kinetics when used for its intended application. Typical unimpregnated adsorbents that are subject to lowered adsorption capacity and/or reduced adsorption kinetics due to environmental contamination include, but are not limited to, activated carbons, silica gels, molecular sieves, polymeric adsorbents, and zeolites. For the case of impregnated adsorbents, environmental contamination can also result in the loss of functionality for their designed purpose. This loss of functionality is a result of a physical or chemical interaction between the impregnant and the environmental contaminate which negatively impacts the desired functionality of the material.

Impregnated adsorbents include, but are not limited to metal, acid, base, salt, and/or organic compound impregnated activated carbons, silica gels, molecular sieves, polymeric adsorbents, and zeolites. Impregnated adsorbents are commonly used as catalysts. Impregnation of the adsorbent with said metal, acid, base, salt, and/or organic compound is typically accomplished by vapor phase deposition, solvent evaporation, solid—solid contact, and similar techniques well known to those skilled in the art.

Those skilled in the art involved in the manufacture, storage, and/or transport of unimpregnated and impregnated adsorbents are well aware of the numerous potential problems in handling adsorbents. As such, care is taken to minimize excessive exposure of the adsorbents to the local environment during processing and subsequent packaging. Packaging is typically selected so that exposure of the adsorbent to environmental contaminates during storage or transport is also minimized. Traditionally, drums, bags, and other types of containers have been used for packaging. These containers can be hermetically sealed to prevent subsequent contamination. However, the typical containers does not provide provision to identify instances where the sealing integrity has been lost, except in instances of obvious container failure. Also, the containers are typically sealed in an ambient air environment in which the entrapped air, at atmospheric pressure, may react with the adsorbent to degrade some of its properties. This degradation may be especially severe in the case of impregnated adsorbents.

The adsorbent, if powdered, granular, pelletized, spherical, or an other type of particulate, is generally "free-flowing" in such containers. As such, the individual particles of the adsorbent are free to move against each other. This movement normally occurs during vibration of the container as, for example, such during with transportation. The result of this movement is the attrition of the adsorbent particles which increases the amount of undesired undersize material in the container. Such attrition is most apparent with granular and pelletized adsorbents. Attrition can also result in an increase in packing density. Vibration during transport can also cause the packing density of the adsorbent to increase. Attrition and vibration can also lead to undesired particle segregation within a container.

In drums or other rigid containers, an increase in packing density results in headspace being created, which in the case of a fixed container produces voids. In non-rigid containers, such as bags, an analogous situation can develop. If the nonrigid container is hermetically sealed, the entrapped gases therein result in the formation of a void space as the packing density of the adsorbent increases. Any external force can pressurize the gases in the void volume, which can result in the hermetic seal being lost causing a complete container failure.

Environmental contamination of adsorbents during manufacture, storage, and/or transportation can also be reduced by packaging the contents under an inert atmosphere. While often effective such operations are difficult to carry out and generally expensive. A particularly significant problem associated with inert gas packaging is the removal of contaminate gases and vapors from the adsorbent prior to or during the inerting process. Likewise, packaging the material under vacuum using known techniques is can result in significantly higher packaging costs because of the specialized procedures used and the equipment required to perform such operations. Vacuum packaging of adsorbents is further complicated by the very nature of the adsorbents themselves. That is, adsorbents adsorb gases and vapors. Removal of such adsorbed gases and vapors from the adsorbent is know to be difficult and requires extensive "pumping-down" with an adequate vacuum source.

The ability of adsorbents to adsorb gases, even at low pressures is well known. Activated carbons have been used to store liquefied gases (U.S. Pat. No. 2,760,598) and as a means to maintain vacuum in closed vessels (U.S. Pat. No. 3,921,844). It is also know that cooling the carbon increases it's effectiveness. Adsorption differs from absorption in that it occurs when the concentration of gas molecules is greater on the surface of the solid that in the bulk phase, there is no chemical reaction involved and the process is reversible; whereas, absorption occurs only when there is bulk penetration of gas molecules into the structure of the solid.

Accordingly, it is the object of the present invention to provide a method for packaging adsorbents which provides improved packing densities, reduced attrition losses, and reduced exposure of the adsorbent to environmental or other contamination. It is further an object of the present invention to provide a method that assists in the identification of instances of packaging failure. It is also an object of the invention to provide a cost effective method for packaging adsorbents.

SUMMARY OF THE INVENTION

The present method provides for the packaging of both unimpregnated and impregnated adsorbents that results in improved packaging densities, reduced attrition losses, and reduced exposure of the adsorbent to environmental or other contamination. Furthermore, the method provides for identification of instances of packaging failure. Generally, the method provides hermetically placing a heated adsorbent into a sealable deformable gas impermeable package. Thereafter, sealing the package and permitting the adsorbent to cool to provide a partial vacuum within the package. As a result of this partial vacuum, the environmental atmospheric pressure deforms the package to firmly compresses the adsorbent in a hermetically sealed lower-pressure environment.

In practice, the deformable gas impervious package comprises a bag. This bag may be of any size and is prepared from any flexible sheet-like material of such composition and thickness as to result in said sheet-like material being essentially impervious to gas or vapor transport there-through and capable of withstanding atmospheric pressure. Examples of suitable materials are well know to those skilled in the art and include, but are not limited to, various plastics, metalized plastics, aluminum or other metal foils, impregnated or coated papers, laminated polyethylene-metal foil bags, and other like materials alone or in combination. The seams of said bag, if any, are preferably sealed in such a manner that they are substantially impervious to gas or vapor transport. Preferably, package must be capable of being hermetically sealed.

Alternatively, the package may be prepared from a rigid or semi-rigid material of such composition and thickness as to result in said rigid or semi-rigid material being substantially impervious to gas or vapor transport there-through. Examples of such materials include, but are not limited to, steel, stainless steel, other metals, rigid or semi-rigid plastics, and other like materials alone or in combination. When prepared from such materials the package is preferably designed and constructed to provide for a reduction of the internal volume while maintaining the impermeability to gas or vapor transport. The seams of the package, if any, are sealed to be impervious to gas or vapor transport. Preferably, such a package preferably incorporates a piston, a bellows, or other such mechanical means to provide a reduction in internal volume, in response to a reduction in the relative interior pressure. Additionally, said package must be capable of being hermetically sealed when so desired The adsorbent at an elevated temperature is placed into the package using any convenient means. Alternatively, the adsorbent can be heated to an elevated temperature while in the container. The elevated temperature is preferably any temperature above ambient that is compatible with the materials of construction of the packaging and the properties of the adsorbent. The greater the differential between the adsorbent and ambient temperature, at the time of sealing the package, the greater the pressure differential between the vessel interior pressure and ambient pressure. The adsorbent in the present invention adsorbs gas through van der Waals adsorption. As will be understood the greater pressure differential the greater the advantages of the present invention. Optimally, the elevated temperature is the maximum temperature at which the integrity of the package is maintained, as determined by the materials of construction of the package, or the maximum temperature to which the absorbent can be exposed without causing any undesired, change therein. For example, 90° C. is the maximum temperature to which the adsorbent can be heated in a laminated polyethylene-aluminum foil bag as higher temperatures will degrade the bag.

Most adsorbents are manufactured using some type of thermal process. A convenient method of obtaining heated adsorbent is at the adsorbent discharge of the last process step, if said process step results in a product at an elevated temperature. If the temperature of the adsorbent is higher than desired immediately following said process step, previously cooled adsorbent may be admixed with the hot adsorbent to result in a mixture having the desired temperature. Packaging of the adsorbent following the last process step using the present invention has a further advantage in that hermetically packaging the adsorbent immediately after production further minimizes any potential for contamination.

The present invention can be practiced in an air or inert gas environment. If the adsorbent can be degraded by exposure to ambient air, provisions should be made to package and hermetically seal under an inert gas atmosphere.

Once filled with the desired amount of adsorbent at the desired elevated temperature, the container is hermetically sealed. This sealing can be accomplished using, but not limited to, heat sealing or any of a variety of mechanical closures or clamps, glues, and/or brazing/welding techniques, compression, or other sealing methods known to those skilled in the art. For example, a suitable seal can be obtained by using a heat sealer in combination with the appropriate bags.

Once sealed, the contents are cooled to essentially ambient temperatures. Cooling may be accomplished by convection, forced air circulation, refrigeration, or any other means known to those skilled in the art. As the heat transfer characteristics of adsorbents are typically poor, an appropriate time period should be allowed to insure adequate cooling.

Using the preferred temperature differential, the walls of the container will collapse so that the adsorbent is compacted and held substantially immobile. Compaction is accomplished by the inherent pressure differential that develops between the interior and exterior of the sealed package by the adsorption of the gases and vapors within the package by the adsorbent upon cooling. That is, cooling of the adsorbent results in adsorption of the gases and/or vapors within the hermetically sealed package. Adsorption lowers the pressure within the package and the degree to which the pressure within the package is lowered, depends upon the adsorption properties of the adsorbent. For example, it has been shown that 1 gram of an adsorbent with a surface area of greater than 1000 $m^2/g$, would have a capacity to adsorb 8 mL of nitrogen, the major component of air, at 30° C. (Meredith, et al. 1967). An adsorbent having a density of 0.5 g/mL will remove about four times its volume of air within the package. As the adsorbent cools and the pressure within the package decreases, atmospheric pressure deforms the walls to reduce the volume of the package. The collapse of the container wall typically proceeds to the mechanical limit or until the walls contact and compress the adsorbent therein. The application of the compressive force by the deformable walls on to the adsorbent forces the adsorbent particles into close contact with each other which improves packing density. Additionally, compaction reduces particle movement and inhibits induced vibration inter-particle abrasion resulting in reduced attrition losses.

The compaction forces exerted by the walls following the present invention are very high. As a result, the deformation and tensioning of the packaging walls, especially when constructed from flexible or semi-flexible materials, is immediately apparent. Deformation provides an obvious indicator that the package has been hermetically sealed. Conversely, if the hermetic seal of the package fails, the relaxation of the walls provides visual indicator of seal failure.

The performance of some adsorbents, especially impregnated adsorbents, can be degraded by exposure to certain components, such as water vapor and oxygen, found naturally in air. Even if packaged under an inert gas, some contamination with these components would be expected. The use of the present invention inherently provides for a reduced gaseous pressure within the package. The reactivity of adsorbents, especially some impregnated adsorbents, with various gases components and vapors is dependent on the partial pressure of said gaseous component or vapor. Therefore, packaging according to the present invention results in less degradation of adsorbent performance during storage or transport than the known art.

The present invention can also be used for packaging adsorbents that have been previously formed into monoliths such as blocks, cylinders, plates, and other similar shaped articles having fixed volumes. When used in this manner, all the benefits of the present invention are obtainable, except that packing density or attrition will not be substantially improved.

In a preferred embodiment of the invention, the adsorbent is powdered, granular, spherical, or pelletized activated carbon, zeolite, molecular sieves, polymeric adsorbents, or silica gel or mixtures thereof. The packaging is preferably a bag made from laminated polyethylene-aluminum foil. The maximum recommended temperature to which the bag can withstand is about 90° C. Therefore, the adsorbent is preferably heated to a temperature between about 40° and 90° C. either inside the bag or prior to placement in the bag. The bag is thereafter hermetically sealed and about ambient temperature.

In an other preferred embodiment, the adsorbent is powdered, granular, spherical, or pelletized activated carbon, zeolite, molecular sieves, polymeric adsorbents, or silica gel or mixtures thereof that have been previously formed into a monolith such as a block, a cylinder, a plate, or other similar shaped article having appreciable volume. The package is preferably a laminated bag made from polyethylene-aluminum foil. The maximum recommended temperature to which the bag can withstand is about 90° C. Therefore, the adsorbent is heated to a temperature between about 40° and 90° C. either inside the bag or prior to placement in the bag. The bag is hermetically sealed and cooled to about ambient temperature.

PRESENTLY PREFERRED EMBODIMENTS

The following examples illustrate preferred embodiments of the present invention but are not intended to limit the scope of the present invention. Example 1 illustrates that the present invention may be practiced with any adsorbent to achieve improvement in packing densities. Example 1 also demonstrates that the method of the present invention can be used with a package having flexible walls. Example 2 demonstrates that the advantages of present invention can be achieved using a rigid wall package. Example 3 illustrates a semirigid wall package and Example 4 demonstrates that the present invention provides reduced attrition losses when the container is subject to mechanical abrasion such as those in transportation. Example 5 illustrates that failure of the hermetic seal is readily observed.

EXAMPLE 1

Two 470 g portions of each of the adsorbents identified in Table 1 were prepared. At room temperature, one portion of each adsorbent was placed individually into an open top laminated polyethylene-aluminum foil bag. The other portion of each adsorbent was heated to approximately 75° C. and then placed into a bag that was of equivalent construction and size to that used for the first portion. Immediately after placement of each adsorbent portion into a bag, the head-space in each bag was minimized as much as possible and the bag sealed. The bags containing the heated adsorbent where then cooled to approximately ambient temperature. The volume of each bag was then determined by submerging each into a water filled vessel and measuring the volume of water displaced. These volumes are listed in Table 1.

As shown in Table 1, the bags filled with the heated adsorbent had volumes lower than those filled with an identical amount of room temperature adsorbent. For all the adsorbents tested, the reduction in volume resulting from use of the present invention was greater than 11%. Adsorbents which were in the form of pellets or spheres exhibited smaller reductions in their respective volumes than did granules or powders. The latter forms of adsorbents are less susceptible to volume reductions because of their size and shape when subjected to the compressive force exerted by the collapsed walls of the vessel. Silica gel, on the other hand, which has a smaller total micropore volume exhibited a smaller reduction in volume than the other adsorbents. Since the mass of each portion of the individual adsorbents was equivalent, the gain in packing density afforded by the present invention is apparent.

TABLE 1

| ADSORBENT TYPE | ADSORBENT FORM | VOLUME OF BAG CONTAINING UNHEATED ADSORBENT | VOLUME OF BAG CONTAINING HEATED ADSORBENT | VOLUME REDUCTION (%) |
|---|---|---|---|---|
| Activated Carbon | Granules | 1114 mL | 1006 mL | 10 |
| Activated Carbon - Copper Impregnated | Granules | 896 mL | 862 mL | 4 |
| Activated Carbon | Pellets | 1068 mL | 1056 mL | 1 |
| Activated Carbon | Powder | 966 mL | 869 mL | 10 |
| Styrene - Divinyl Benzene Polymer | Granules | 1009 mL | 907 mL | 11 |
| Silica gel | Granules | 963 mL | 949 mL | 1 |
| Molecular Sieves 3A | Pellets | 595 mL | 591 mL | 1 |
| Molecular Sieves 4A | Spheres | 596 mL | 587 mL | 2 |
| Zeolite | Pellets | 904 mL | 878 mL | 3 |

EXAMPLE 2

A circular piece of glass wool filter paper of syringe bore diameter was inserted into the bottom of a 100 mL glass syringe fitted with a Luer-lok valve. With the syringe plunger removed and the valve open, 28.5 grams of pulverized adsorbent (in this example activated carbon) at ambient temperature was placed into the syringe body. The plunger was replaced and pressed into the syringe as far as possible. The volume of the carbon as determined from the syringe barrel calibrations marks was 68 mL.

The syringe was cleaned and again a circular piece of glass wool filter paper of syringe bore diameter was inserted into the bottom of the syringe. With the syringe plunger removed and the valve open, 28.5 grams of pulverized adsorbent (in this example activated carbon) was placed into the syringe body. With the valve open, the plunger was replaced and pressed into the syringe as far as possible. After ensuring that the valve was open, the syringe and its contents were heated in an oven to a temperature of 75° C. The syringe was removed from the oven and the valve immediately closed. After cooling to approximately ambient temperature, the volume of the carbon as determined from the syringe barrel calibrations marks was 60 mL.

The reduction in carbon volume achieved by heating the carbon prior to sealing the vessel (in this case a syringe) demonstrates that the present invention may be practiced using a vessel having walls constructed from rigid materials and so designed and otherwise engineered as to provide for a reduction in interior volume.

EXAMPLE 3

A new metal can of the type commonly referred to a "one gallon paint can" was filled to the top with granular activated carbon. The carbon-containing can, with the lid removed, was heated in an oven to 75° C. After reaching temperature, the can was removed from the oven and the lid firmly placed onto the can. As the carbon-containing can cooled, large dents developed in the sides of the can. After reaching ambient temperature, the can had the appearance of being partially crushed illustrating that the present invention can be practiced using vessels having semi-rigid walls. This example not only illustrates the package volume reduction achieved by use of the present invention but also illustrates the significant differential that develops between the vessel interior pressure and ambient pressure.

EXAMPLE 4

Two equivalent 100 g portions of granular activated carbon were prepared. At room temperature, one portion of each adsorbent was placed individually into an open top laminated polyethylene-aluminum foil bag. The other portion of each adsorbent was heated to approximately 75° C. and then placed into a bag that was of equivalent construction and size to that used for the first portion. Immediately after placement of each adsorbent portion into a bag, the head-space in each bag was minimized as much as possible and the bag sealed. The bags containing the heated adsorbent where then cooled to approximately ambient temperature. Each of the bags were secured to a sieve screen (U.S. Standard Screen No. 4) and placed in a seive shaker apparatus (W.S. Tyler Co. Model RX-19-1 Ro-Tap Shaker). The seive shaker was operated for 10 hours with the bags in place to simulate the vibrational forces which these materials may be subjected to during handling and transport. Upon completion of the test, the bags were opened and the activated carbons were subjected to screen size distribution determinations (Calgon Carbon Test Method TM-8, Calgon Carbon Corporation, November 1995).

Table 2 presents the results of the screen size distribution determinations. As shown in Table 2, the contents of the bag filled with the heated adsorbent exhibited less attrition of the adsorbent than the bag containing the unheated adsorbent. This is exemplified by larger quantities of material retained on the 16 and 20 mesh screen and the smaller quantities on the 20, 30, 40, and 50 size screens and pan for the package containing the heated adsorbent versus the bag containing the unheated adsorbent. This is due to the granules in the heated bag being held tightly within the container and not being able to move against each other. On the other hand, the granules in the unheated bag are free to move against one another causing attrition of the granules. As the portion of the individual samples were equivalent, the reduction in attrition afforded by the present invention is apparent.

TABLE 2

| U.S. Standard Screen | BAG CONTAINING UNHEATED ADSORBENT | BAG CONTAINING HEATED ADSORBENT | CHANGE (%) |
|---|---|---|---|
| | % on U.S. Standard Screen | | |
| 12 | 0.01 | 0.01 | 0 |
| 16 | 22.3 | 23.4 | 5 |
| 20 | 51.4 | 52.2 | 2 |
| 30 | 21.8 | 21.1 | −3 |
| 40 | 3.1 | 2.7 | −13 |
| 50 | 0.17 | 0.12 | −29 |
| Pan | 1.17 | 0.40 | −66 |

EXAMPLE 5

A 470 gram portion of granular activated carbon was heated to approximately 75° C. and then placed into a laminated polyethylene-metal aluminum bag. Immediately after placement of the carbon into the bag, the bag head-space was minimized as much as possible and the bag heat sealed. The bag was then cooled to approximately ambient temperature. Visually, it was observed that the bag was tightly constricted around its carbon contents and the outer contours of many of the carbon granules were duplicated on the exterior bag surface. Shaking the bag did not produce any sound of particle movement. The hermetic seal of this bag was then intentionally broken by puncturing the bag wall. Immediately, a sound was heard that was attributed to the passage of ambient air into the bag through the puncture. It was also observed that the walls of the bag were not longer tightly constricted around its carbon contents. Handling of the bag showed that the carbon granules were somewhat loosely heard that was attributed to the passage of ambient air into the bag through the puncture. It was also observed that the walls of the bag were not longer tightly constricted around its carbon contents. Handling of the bag showed that the carbon granules were somewhat loosely packed within the bag. Shaking the bag produced the sound of particle movement. This example illustrates that the present invention provides for packaging that is intrinsically different from conventional packaging and that failure of the hermetic seal is readily observed.

While presently preferred embodiments of the invention have been described in particularity, the invention may be otherwise embodied within the scope of the appended claims.

While presently preferred embodiments of the invention have been described in particularity, the invention may be otherwise embodied within the scope of the appended claim.

What is claimed is:

1. A method for hermetically packing adsorbents comprising the steps of:

(a) hermetically sealing said adsorbent in a gas impermeable hermetically sealable package, said adsorbent being at elevated temperature and (b) hereafter cooling said package to about ambient temperature to provide a reduced pressure within said package by adsorption into said adsorbent, said reduced pressure being reduced below that pressure attainable by cooling said package without said adsorbent.

2. The method of claim 1 wherein the adsorbent is not impregnated.

3. The method of claim 1 wherein the adsorbent is impregnated.

4. The method of claim 1 wherein the adsorbent is activated carbon, silica gel, zeolites, molecular sieves, polymeric adsorbents, or combinations thereof.

5. The method of claim 1 wherein the adsorbent is impregnated activated carbon, silica gel, molecular sieves, polymeric adsorbents, zeolite, or combinations thereof.

6. The method of claim 5 wherein said impregnant is a metal, a salt, an acid, a base, or an organic compound.

7. The method of claim 1 wherein said package includes at least one wall constructed from a rigid, semi-rigid, or flexible gas and vapor impermeable material.

8. The method of claim 1 wherein the package comprises a bag constructed from gas and vapor impermeable materials.

9. The method of claim 8 where said impermeable materials comprises a laminated polyethylene-aluminum foil.

10. The process of claim 1 wherein said hermetic sealing is accomplished by heat-sealing, gluing, welding, brazing, mechanical closures or clamps, or compression.

11. The method of claim 1 where said cooling is accomplished by convection, forced air circulation, refrigeration, or any combination thereof.

12. A method for packaging an adsorbent comprising the steps of:

(a) placing an adsorbent at a temperature higher than ambient into a gas impervious hermetically sealable package and (b) sealing said package while the adsorbent is at a temperature above ambient to provide a reduced pressure within said package by adsorption into said adsorbent, said reduced pressure being reduced below that pressure attainable by cooling said package without said adsorbent.

13. A method for packaging an adsorbent comprising the steps of:

(a) placing an adsorbent in a gas impervious hermetically sealable package, (b) heating said adsorbent to a temperature above ambient and (c) hermetically sealing said package to provide a reduced pressure therein by adsorption into said adsorbent, said reduced pressure being reduced below that pressure attainable by cooling said package without said adsorbent.

14. The method claimed in claim 12 or 13 wherein said package and adsorbent are cooled.

15. The method set forth in claim 12 or 13 including the step of degassing said package to a pressure less than ambient prior to hermetically sealing.

* * * * *